US008220662B2

(12) United States Patent
Drennow

(10) Patent No.: US 8,220,662 B2
(45) Date of Patent: Jul. 17, 2012

(54) DEVICE FOR DISCHARGE OR OUTFEED AND DISCHARGE MEANS FOR SUCH DEVICE

(75) Inventor: Sten Drennow, Lund (SE)

(73) Assignee: Asept International AB, Lund (SE)

( * ) Notice: Subject to any disclaimer, the term of this patent is extended or adjusted under 35 U.S.C. 154(b) by 577 days.

(21) Appl. No.: 12/519,942

(22) PCT Filed: Dec. 18, 2007

(86) PCT No.: PCT/SE2007/051024

§ 371 (c)(1), (2), (4) Date: Jul. 17, 2009

(87) PCT Pub. No.: WO2008/079089

PCT Pub. Date: Jul. 3, 2008

(65) Prior Publication Data

US 2010/0213210 A1 Aug. 26, 2010

(30) Foreign Application Priority Data

Dec. 22, 2006 (SE) ..... 0602781

(51) Int. Cl.
*B67D 1/00* (2006.01)

(52) U.S. Cl. ..... 222/82; 206/222; 222/391

(58) Field of Classification Search ..... 222/82, 222/83, 83.5, 84–88, 325–327, 387, 391, 222/105; 206/219, 222
See application file for complete search history.

(56) References Cited

U.S. PATENT DOCUMENTS 3,166,096 A 1/1965 Lang
(Continued)

FOREIGN PATENT DOCUMENTS

CA 1218340 A1 2/1987
(Continued)

OTHER PUBLICATIONS

Extended European Search Report. Application No./Patent No. 078611191-2316 / 2099707 PCT/SE2007051024. Date of completion of the search Mar. 25, 2011.

(Continued)

*Primary Examiner* — Lien Ngo
(74) *Attorney, Agent, or Firm* — Mollborn Patents, Inc.; Fredrik Mollborn

(57) ABSTRACT

A device for feeding out liquid or substantially liquid contents from a storage container (2) comprises an outfeed container (3) for the storage container and a discharge means (6) for outfeed of the contents from the storage container by squeezing it. The storage container (2) has an inner connecting element (7) for connection to an outer connecting element (8) by the latter's penetration of the container wall at the inner connecting element. The storage container (2) is connected via the outer connecting element (8) to a valve means (9) with a valve body (10) which in a resting position abuts against a valve seat and which, for outfeed, is open able by the contents of the storage container being pressed against the valve body so that the latter leaves the valve seat. The valve body (10) has elastic properties and a normal shape when it abuts against the valve seat so that it closes the valve means (9). For outfeed, the valve body (10) assumes a stretched shape and leaves the valve seat. The valve body (10) quickly reverts from stretched to normal shape when the pressure upon it from the contents of the storage container (2) ceases. The discharge means (6) of said device comprises a pressure means (11) and a pressure application means (12) which, via the pressure means, exerts upon the storage container (2) in the outfeed container (3) a pressure for outfeed of the contents from the storage container.

34 Claims, 7 Drawing Sheets

U.S. PATENT DOCUMENTS

| | | | | | |
|---|---|---|---|---|---|
| 3,682,356 | A | | 8/1972 | Karle | |
| 4,792,064 | A | | 12/1988 | Loesel, Jr. et al. | |
| 5,069,364 | A | * | 12/1991 | McGill | 222/95 |
| 5,184,757 | A | * | 2/1993 | Giannuzzi | 222/82 |
| 5,429,273 | A | * | 7/1995 | King et al. | 222/82 |
| 5,505,336 | A | * | 4/1996 | Montgomery et al. | 222/82 |
| 5,897,028 | A | * | 4/1999 | Sauer | 222/82 |
| 6,012,610 | A | * | 1/2000 | Pauser et al. | 222/88 |
| 6,092,695 | A | | 7/2000 | Loeffler | |
| 6,131,766 | A | | 10/2000 | King et al. | |
| 6,802,436 | B2 | * | 10/2004 | Drennow et al. | 222/82 |
| 7,552,845 | B2 | * | 6/2009 | Guryevskiy | 222/86 |
| 2006/0054641 | A1 | | 3/2006 | Evers | |

FOREIGN PATENT DOCUMENTS

| | | | |
|---|---|---|---|
| JP | 06255684 | A | 9/1994 |
| WO | WO 94/10081 | A1 | 5/1994 |

OTHER PUBLICATIONS

International Search Report and Written Opinion of the International Searching Authority; International Application No. PCT/SE2007/051024; Completed Feb. 29, 2008.

* cited by examiner 9
8
42
36
35
31
30
45

9
8
42
36
35
31
50
30
46
10
32
33

9
8
42
36
35
45
V
31
33
34
50
30
46
10
32

Fig. 7
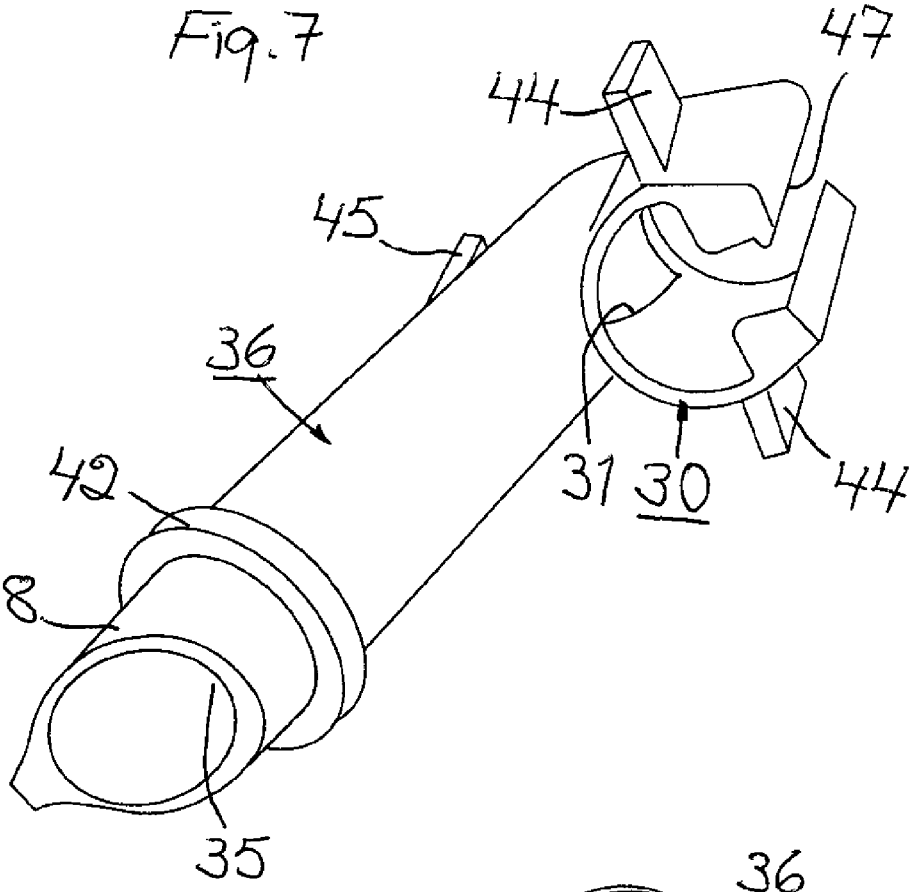
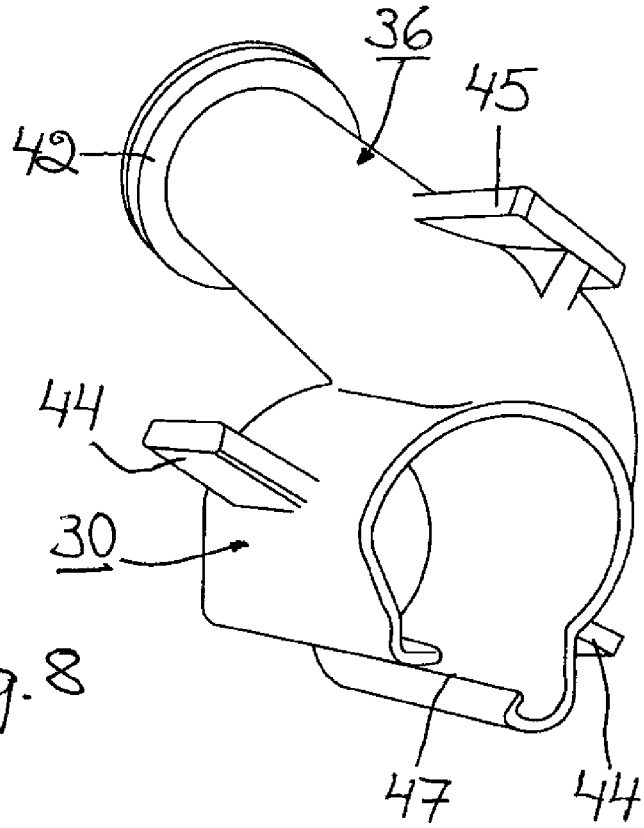
Fig. 8

Fig. 11
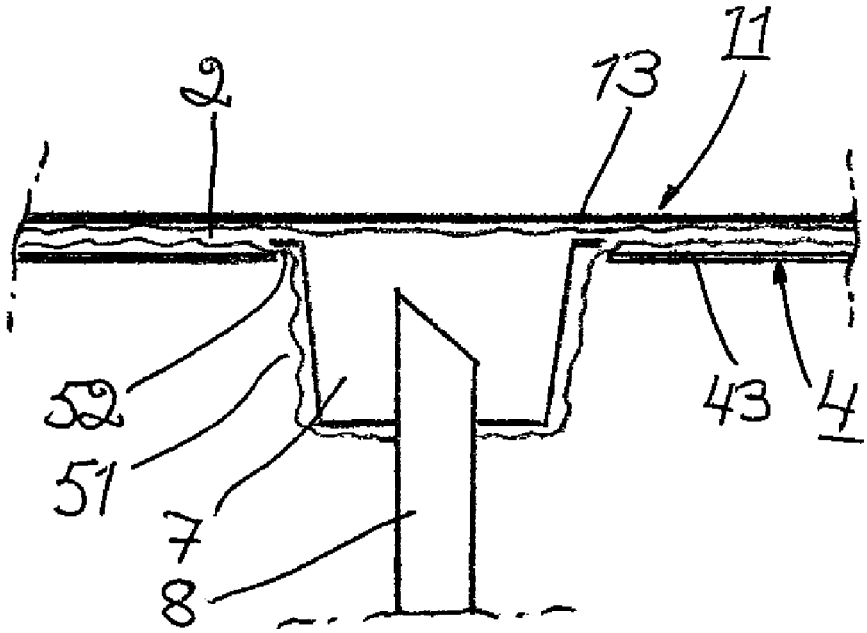
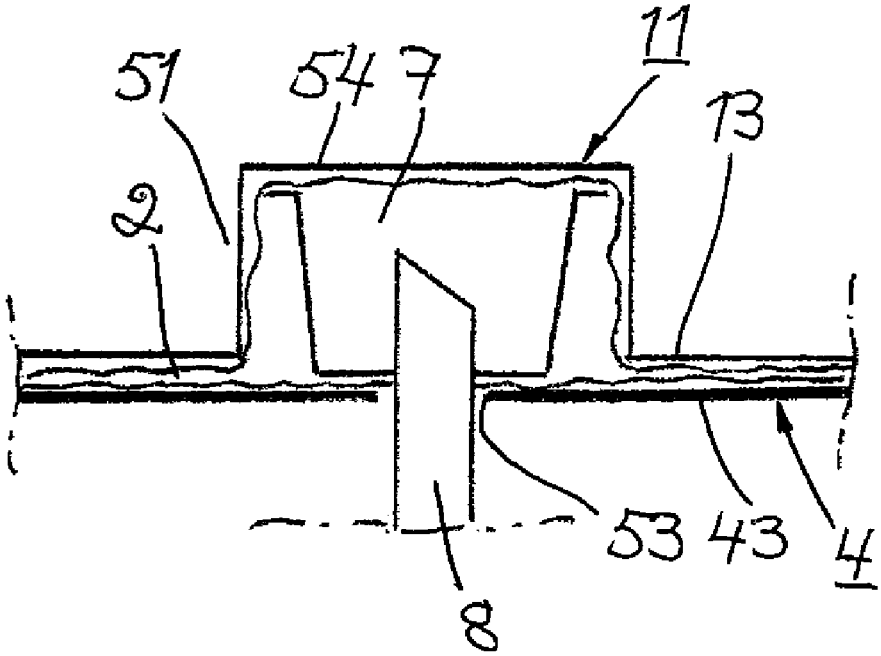
Fig. 12

DEVICE FOR DISCHARGE OR OUTFEED AND DISCHARGE MEANS FOR SUCH DEVICE

BACKGROUND OF THE INVENTION

The present invention relates to a device for feeding out liquid or substantially liquid contents, preferably food items such as mayonnaise, mustard, tomato ketchup etc., from a flexible squeezable purpose-made storage container, which device comprises an outfeed container in which said storage container resting on the bottom of the outfeed container and supported by the sidewalls of the outfeed container is adapted to feeding out the contents therefrom, and a discharge means at the top of the outfeed container for pressure action from above upon the storage container for feeding out at the bottom the contents of the storage container by squeezing it, which storage container has a connecting element disposed internally in it by which the container, for outfeed, is connectable to an outer connecting element by the latter's penetration of the container wall at the inner connecting element, the storage container being connected via the outer connecting element to a valve means with a valve body which in a resting position abuts against a valve seat and which, for outfeed, is openable by the contents of the storage container being pressed against the valve body so that the latter is caused to leave the valve seat.

The present invention relates also to a discharge means for said device.

BRIEF SUMMARY OF THE INVENTION

The object of the present invention is, inter alia, to configure the device defined above in such a way that it makes it possible to quickly feed out relatively large amounts from the contents of the storage container, to quickly open and close the valve means and to quickly and easily clean, in particular, the valve means.

This object is achieved according to the invention primarily by the valve body having elastic properties and a normal shape in which it abuts against the valve seat so that it closes the valve means, by the shape of the valve means being variable so that when it is subjected, for outfeed, to pressure from the contents of the storage container it is caused to change to a stretched shape and thereupon leave the valve seat, and by the valve body being adapted to reverting from stretched to normal shape when the pressure on it from the contents of the storage container ceases, and hence to abutting against the valve seat and quickly closing the valve means.

The configuration and elasticity of the valve body make it possible for the valve means, when the pressure from the contents of the storage container increases for outfeed, to open greatly, distinctly and momentarily and, when said pressure ceases, in the same way to close quickly and discontinue the outfeed without spillage.

The discharge means of said device comprises on its side, for rapid and easy feeding out of large quantities of the contents from the storage container, both a pressure means and a pressure application means which, via the pressure means, exerts upon the storage container in the outfeed container a pressure at the bottom of the storage container for outfeed of its contents.

Other objects and advantages of the invention will suggest themselves to one skilled in the art who examines the attached drawings and the following detailed description of preferred embodiments.

BRIEF DESCRIPTION OF THE DRAWINGS

FIGS. 7 and 8 are perspective views of the valve means according to FIGS. 4 to 6 without the valve body;

FIGS. 11 and 12 are sectional views according to alternative versions of part of the device according to the invention.

DETAILED DESCRIPTION OF PREFERRED EMBODIMENTS OF THE INVENTION

Figure 3:
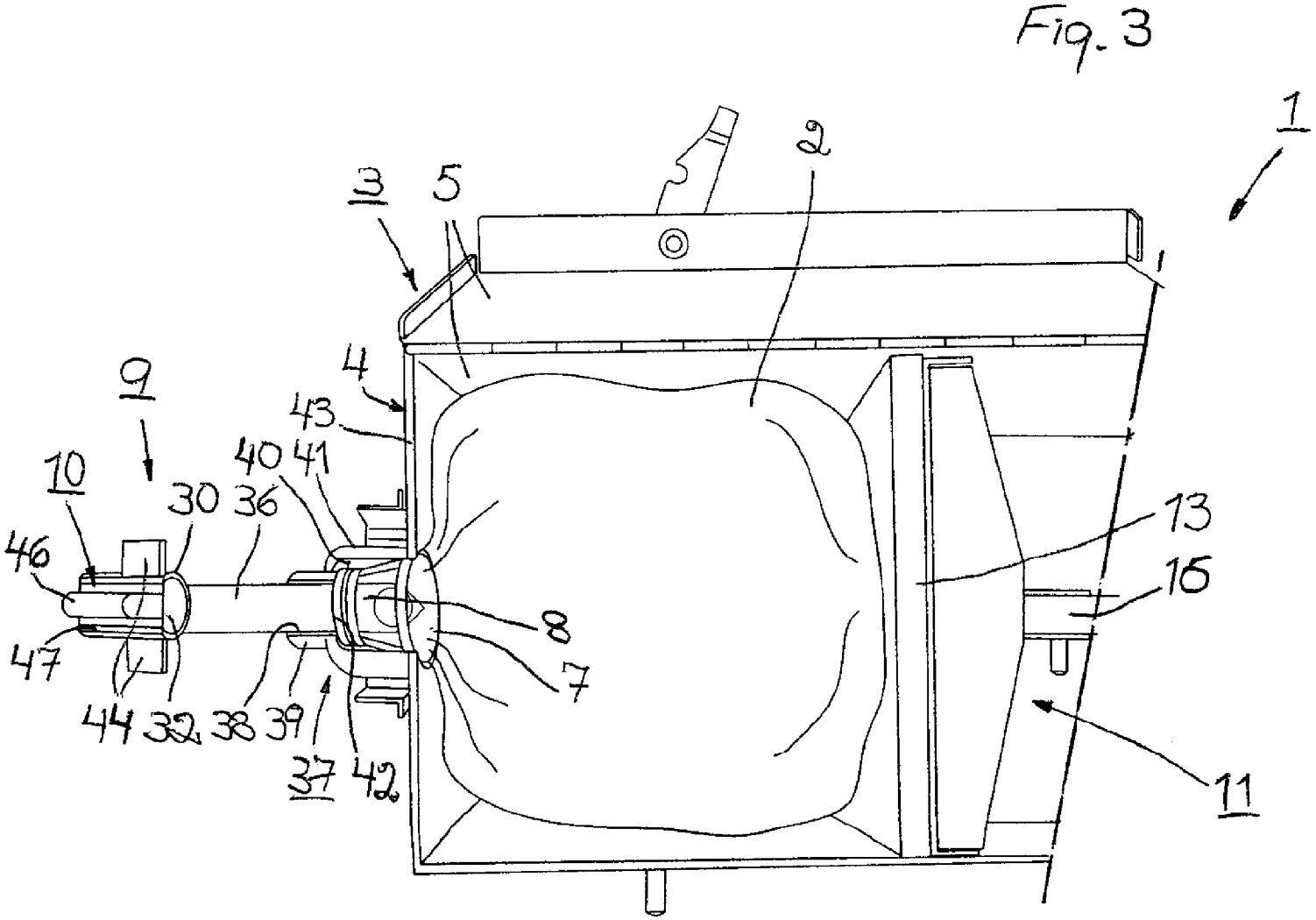
FIG. 3 is a side view of the outfeed container, with a storage container placed in it, and of parts of the discharge means.
Figure 6:
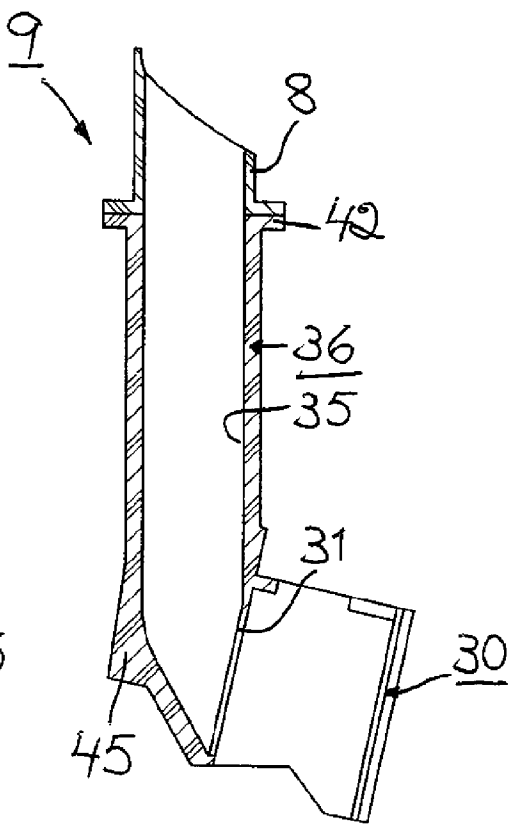
FIGS. 4 to 6 are sectional views through the valve means which forms part of the device according to the invention, with the valve body in various extraction or insertion positions and with the valve body in resting and open positions respectively.
Figure 5:
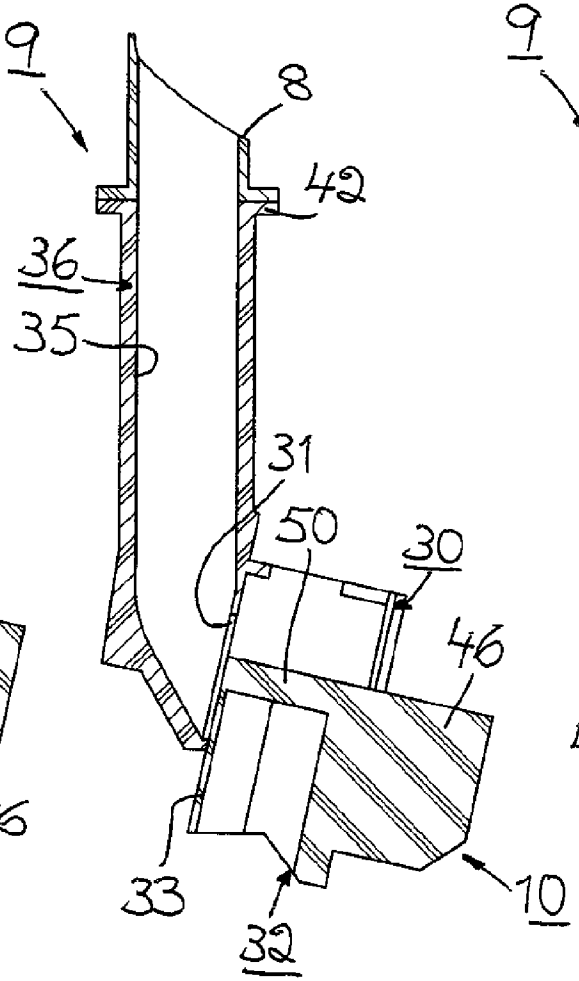

The present invention thus relates to a device 1 for feeding out liquid or substantially liquid contents, preferably food items such as mayonnaise, mustard, tomato ketchup etc., from a flexible squeezable purpose-made storage container 2 (see FIG. 3). The storage container 2 may have a volume of, for example, about 5 liters. The device 1 comprises an outfeed container 3 which in the version depicted is quadrilateral and in which said storage container 2 resting on the bottom 4 of the outfeed container 3 and supported by sidewalls 5 of the outfeed container is adapted to feeding out the contents from the storage container. The storage container 2 with contents has to at least a substantial extent a larger circumference than the outfeed container 3 in which the storage container is disposed, i.e. the circumference of the storage container exceeds the composite width of the sidewalls 5 of the outfeed container. The storage container 2 thus abuts assuredly against and is supported by the sidewalls 5 of the outfeed container 3 throughout the outfeed process, so that there is no risk of the storage container disintegrating when squeezed. One of the sidewalls 5 of the outfeed container 3 is preferably openable, facilitating the insertion of the storage container and the removal of the empty storage container. At the top of the outfeed container 3, where the latter is preferably open, a discharge means 6 is disposed for pressure action from above upon the storage container 2 for feeding out at the bottom the contents from the storage container by squeezing it. This discharge means 6 and its function are described in more detail below. The storage container 2 has in a known manner an internal connecting element 7 disposed inside it. The connecting element 7 is disposed on an unbroken section of the wall of the storage container 2. For outfeed, the storage container 2 is connectable by the connecting element 7 to an outer connecting element 8 by the latter penetrating the container wall at the inner connecting element. The connecting elements 7, 8 cooperate with one another in such a way that a fluid-tight connection is created between them (see preferably FIG. 3). The storage container 2 is also connected via the outer connecting element 8 to a valve means 9 with a valve body 10 which in a resting position (position V in FIG. 4) abuts against a valve seat and which, for outfeed, is openable (e.g. position Ö in FIG. 4) by the contents of the storage container being pressed against the valve body so that the latter is caused to leave the valve seat. To this end, the valve body 10 has elastic properties and a normal shape in which it abuts against the valve seat so that it closes the valve means 9. The shape of the valve body 10 is also variable so that when the valve body 10 is subjected, for outfeed, to a specified pressure from the contents of the storage container 2, it is caused to change to a stretched shape. The valve body 10 thereupon leaves its abutment against the valve seat and the valve means 9 opens. The valve body 10 is adapted to reverting from stretched to normal shape when the pressure on it from the contents of the storage container 2 ceases. The result is renewed abutment against the valve seat and rapid closing of the valve means 9. The shape and elasticity of the valve body 10 cause it to close, i.e. abut against the valve seat, with initially great force and to present great resistance to outfeed, but as the feeding out proceeds and increases, the valve body is pushed into what may be described as an unstable state from which the valve body quickly snaps in and opens greatly. The shape of the valve body 10 changes from normal to stretched. When the outfeed ceases, the valve body 10 snaps quickly back, i.e. changes from stretched to normal shape, and cuts off the flow from the storage container 2 without spillage.

The aforesaid discharge means 6 comprises a pressure means 11 and a pressure application means 12 which, via the pressure means, exerts from above upon the storage container 2 in the outfeed container 3 a pressure for outfeed of the contents from the storage container at the bottom of it.

Figure 1:
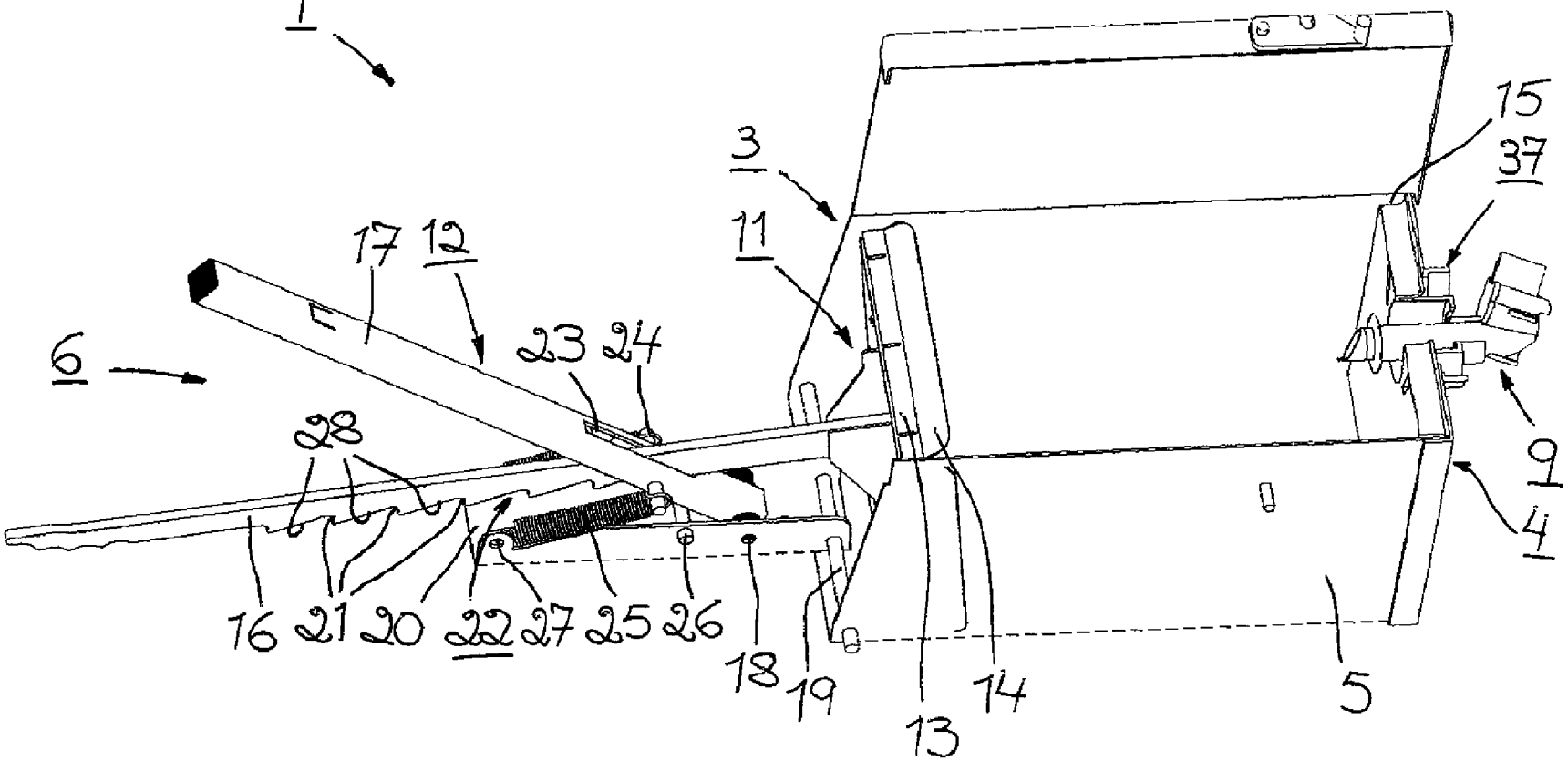
FIG. 1 depicts in a perspective view the device according to the invention and, in particular, the discharge means for the device.
Figure 2:
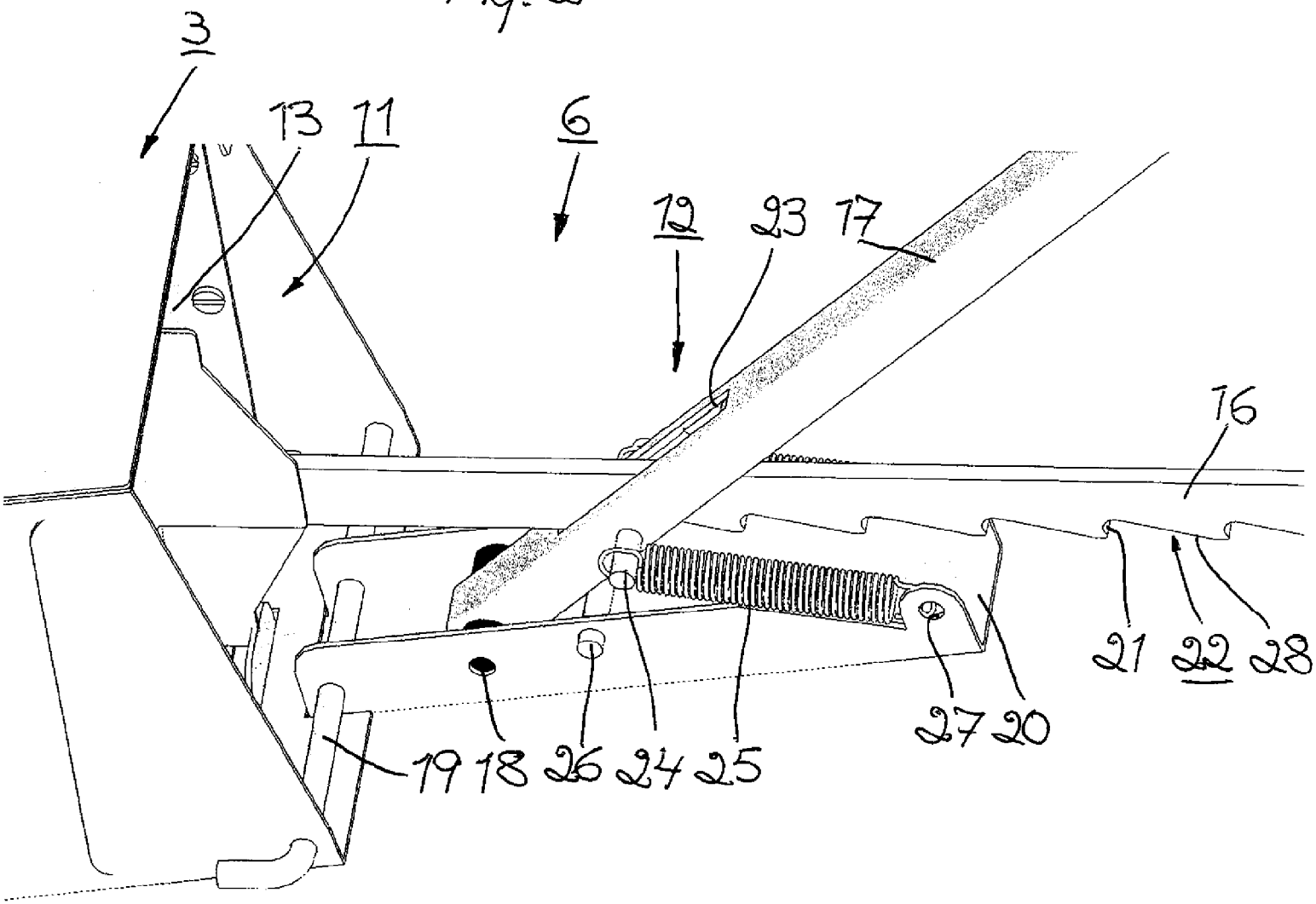
FIG. 2 depicts in a perspective view part of the discharge means according to FIG. 1.

The pressure means 11 takes the form, in the preferred version depicted, of a pressure plate 13 which is fittable movably in the outfeed container 3 and which, for outfeed of the contents from the storage container 2, is caused to abut and press against the storage container and squeeze the latter against the bottom 4 of the outfeed container 3. The pressure plate 13 is with advantage so configured that in cross-section it is of substantially the same size and shape as the outfeed container 3, i.e. preferably quadrilateral, but may also be, for example, circular or oval. The pressure plate 13 may also be of any suitable shape for the intended purpose and be made of any suitable material. The pressure plate 13 may thus have round it, along its edge, means, preferably one or more lips 14 made of flexible material (see FIG. 1), which, during pressure action upon the storage container 2, are pushed out by this container towards the sidewalls 5 of the outfeed container 3 for cooperation therewith, and which thus prevent parts of the storage container from passing the pressure plate and becoming jammed between the latter and the outfeed container. For optimum effect and to enable it/them to effectively push out against the sidewalls 5 of the outfeed container 3, the configuration and number of the lip or lips 14 may vary, e.g. depending on the cross-sectional shape of the pressure plate 13 and of the outfeed container. The fact that the storage container 2 does not become jammed between the pressure plate 13 and the outfeed container 3 results in optimum emptying of the storage container, i.e. minimises the remnants of the contents of the storage container. Said one or more lips 14 are directed towards the bottom 4 of the outfeed container 3, so said bottom is with advantage provided with one or more corresponding depressions 15 for the lips and for wall sections of the storage container 2 when the pressure plate 13 begins to approach this bottom.

The pressure application means 12 takes with advantage the form of a lever mechanism. With suitable dimensioning and suitable choice of material, the pressure application means 12 may thus make it possible, in one outfeed movement, to feed out nearly a liter of the contents from the storage container 2. The pressure application means 12 has, in the preferred version depicted, a pressure application arm 16 which is connected to the pressure means 11, i.e. the pressure plate 13, and which by means of a operating lever 17 is movable in order to move the pressure means. The pressure application arm 16 is connected to the operating lever 17 preferably by a one-way connection. This one-way connection results in the pressure application arm 16 being disconnectable from the operating lever 17 so that, for example, the pressure means 11 can be moved back, in a direction opposite to the outfeed direction, to an initial position for changing of the storage container 2. One-way connection therefore means here a connection which functions in one direction but allows freedom of movement in the opposite direction. Changing the storage container 2 can thus be effected quickly and easily. In the particular version depicted in the drawings, for movement of the pressure application arm 16, the operating lever 17 is supported pivotably about a spindle 18 which is firmly supported in a rail 20 connected to the outfeed container 3, on which it is preferably supported via a spindle 19. Alternatively, the operating lever 17 may be supported firmly on the spindle 18 which is itself supported for pivoting in the rail 20, so that the operating lever is still pivotable. The pressure application arm 16 is placeable in a plurality of different functional positions in order, as the storage container 2 is squeezed and emptied of its contents, to allow continued outfeed of its contents. Each of said functional positions along the pressure application arm 16 is defined by a straight or a recessed tooth section 21 of a toothed track 22 running in the longitudinal direction on the pressure application arm. This tooth section 21 runs transversely or substantially transversely to the longitudinal direction of the toothed track 22. In the preferred version depicted, the operating lever 17 is provided with a recess 23 which runs through the lever in the longitudinal direction of the lever and which has the pressure application arm 16 running through it. The operating lever 17 supports a spindle 24 which runs transversely through the recess 23 and is caused to cooperate with respective tooth sections 21 of a toothed track 22 for outfeed of the contents from the storage container 2.

To achieve the lever effect, the operating lever 17 is spring-loaded by a spring 25 between the operating lever (at the spindle 24) and the rail 20. The operating lever 17 is placeable in a first extreme position in which substantially no pressure action is exerted upon the storage container 2 via the pressure application arm 16. This first extreme position is defined, in the version depicted of the discharge or outfeed device, by a stop in the form of a spindle 26 which is supported in the rail 20 between the spindle 18 and a bracket 27 for the spring 25 in the rail. From the first extreme position, the operating lever 17 is pivotable against the spring force towards the outfeed container 3 for outfeed and pressure action upon the storage container 2 via the pressure application arm 16 resulting from the cooperation of the spindle 24 in the operating lever with one of the tooth sections 21 of the toothed track 22 on the pressure application arm. During outfeed and pressure action upon the storage container 2 via the pressure application arm 16, the operating lever 17 is pivotable against the spring force towards a second extreme position in which no further outfeed is possible. This second extreme position is defined, for example, by the operating lever 17 abutting against the outfeed container 3. When the outfeed ceases, the operating lever 17 is moved back by the spring force towards the first extreme position, thus drawing the spindle 24 along a tooth section 28 of the toothed track on the pressure application arm 16, which tooth section is positioned somewhat obliquely relative to the longitudinal direction of the toothed track 22.

The pressure application means 12 is preferably so configured that when the outfeed ceases the operating lever 17 is moved back by the spring force towards the first extreme position so that the spindle 24 is drawn along the toothed track 22 on the pressure application arm 16 for a distance substantially corresponding to the distance by which the pressure application arm moved during the outfeed.

Accordingly, if for outfeed the operating lever 17 is caused to pivot against the spring force to the second extreme position and, when the outfeed ceases, the operating lever is moved back by the spring force towards the first extreme position and the spindle 24 is thus drawn along the toothed track 22 on the pressure application arm 16, the spindle is caused to assume the next functional position (in the next tooth section 21) for a new outfeed operation.

To sum up, an outfeed operation is effected briefly as follows:

The outfeed is initiated by the operating lever 17 being caused to pivot from the position in which it preferably rests against the spindle 24. This involves the pressure application arm 16 being moved via the spindle 24 in the operating lever 17 and a tooth section 21 of the toothed track 22. The pivoting of the operating lever 17 causes the pressure plate 13 to be moved via the pressure application arm 16 and be caused to press against the storage container 2 for squeezing of the container and outfeed of its contents. At the same time, the spring 25 is tensioned. An outfeed stroke, if not discontinued before, is limited by the operating lever 17 reaching, at constantly increasing spring tension, the second extreme position. When the operating lever 17 thereafter is brought back towards the first extreme position, the spring 25 contracts. At the same time, the spindle 24 in the recess 23 in the operating lever is drawn along the pressure application arm 16. The spindle 24 slides from a tooth section 21 along the tooth section 28 of the toothed track 22 to a subsequent functioning position in which the spindle is in another tooth section 21 of the toothed track 22 for outfeed.

The outfeed effected via the previously described discharge means 6 or via a differently constructed discharge means acts upon a valve means 9 as above in which the valve seat has a tubular element 30, with at least one hole 31 in the side of the tubular element for the contents fed out from the storage container 2, and in which the valve body 10 takes the form of a hose 32 made of or comprising flexible material and the outside of the valve body in the resting position V abuts closely against the inside of the tubular element round the hole so that the hose closes the hole. With the object of promoting flexibility and facilitating the outfeed, the section 33 of the hose 32 which abuts against the tubular element 30 round the hole 31 in the version depicted is of smaller wall thickness than other parts of the hose.

Figure 4:
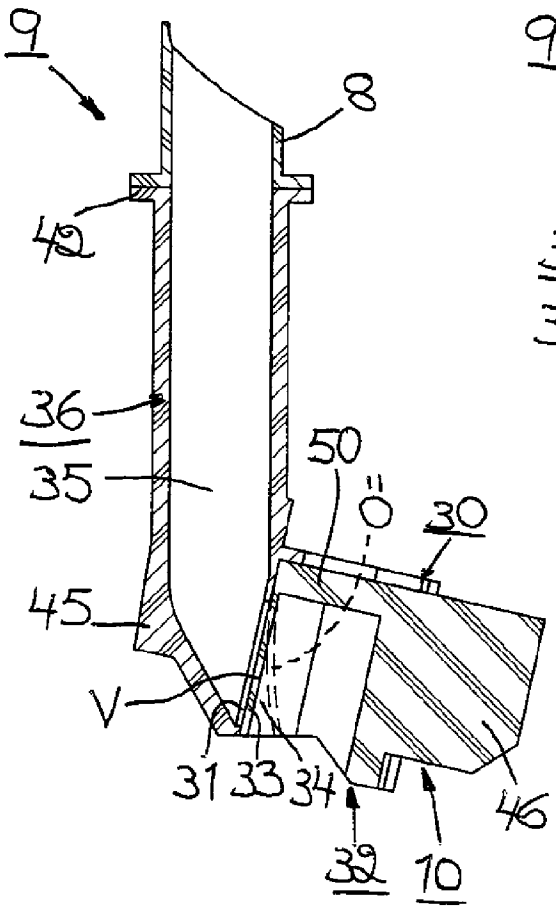
Figure 9:
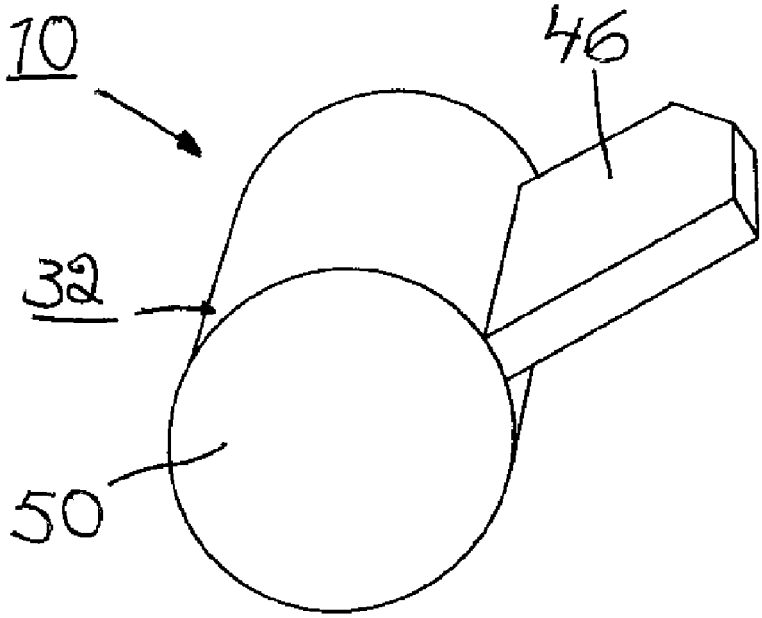
FIGS. 9 and 10 are perspective views of the valve body.
Figure 10:
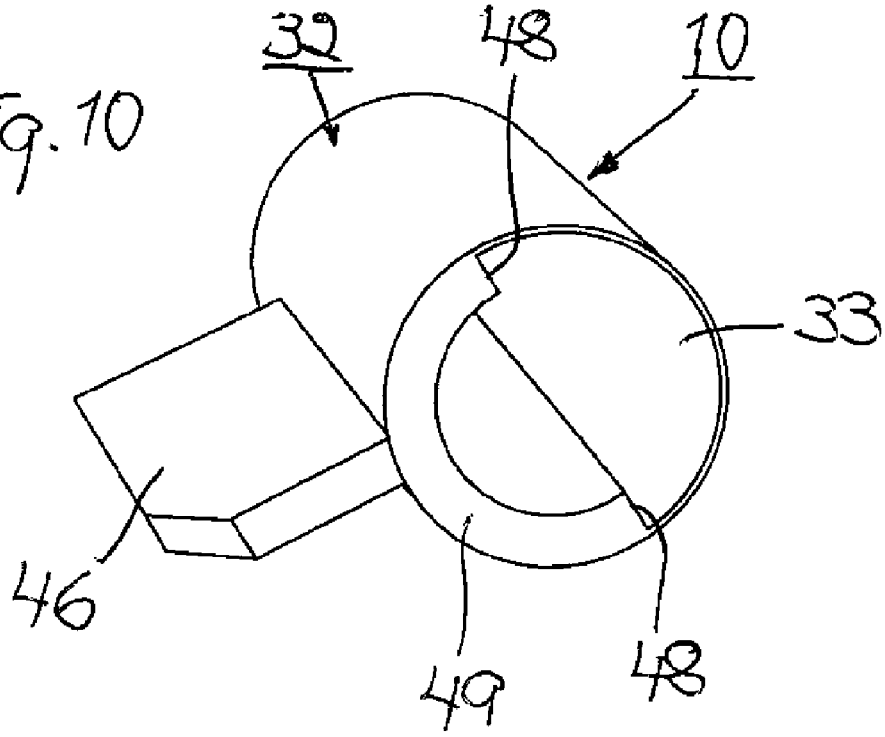

With the object of facilitating the outfeed and making it possible by a single outfeed stroke to discharge in a very short time, e.g. two seconds, nearly about a liter of the contents from the storage container 2, the valve means 9 is also so configured that when the valve body 10 assumes the open position Ö a substantially straight discharge channel 34 is formed at the valve body, which channel runs substantially coaxially with, and is of substantially the same diameter as, an outfeed channel 35 upstream of the discharge channel (FIG. 4).

In order, for example, to facilitate the cleaning of the various parts of the valve means 9, the valve body 10 in the form of a hose 32 can be extracted from the tubular element 30 which constitutes the valve seat and can, after cleaning, be reinserted therein.

In the preferred version depicted (FIGS. 4 to 8) the tubular element 30 which constitutes the valve seat is connected to the outer connecting element 8 via a substantially tubular valve holder 36. The valve holder 36 delineates said outfeed channel 35 upstream of the discharge channel 34. By means of the valve holder 36, the valve means 9 is fixable to the outfeed container 3 via a substantially tubular bracket 37 at the bottom of said container. Thus the valve means 9 is kept stable relative to the outfeed container 3 and the outfeed is facilitated. To this end, the tubular element 30 which constitutes the valve seat, and the valve holder 36 and the outer connecting element 8 are with advantage also integral with one another.

The bracket 37 for the valve means 9 comprises, in the preferred version depicted (FIG. 3), a substantially tubular element 39 provided with a slit 38 and of relatively small diameter for firmly snapping onto the valve holder 36. The slit makes it possible for said element 39 to spring a little when the valve holder 36 is pressed into it from the side. The bracket 37 also comprises a substantially tubular element 41 disposed coaxially with the element 39, provided with a slit 40 and of relatively large diameter for the insertion therein of the inner and outer connecting elements 7, 8 with associated parts of the storage container 2. The smaller-diameter element 39 of the bracket 37 constitutes, for firm snapping onto the valve holder 36, a stop for a flange 42 on the valve holder at the latter's transition or connection to the outer connecting element 8. The bracket 37 is with advantage integral with a detachable plate 43 which constitutes the bottom 4 of the outfeed container 3 or a plate disposed on the bottom of the outfeed container. This makes it easy to detach the bracket 37 and the plate 43 from the outfeed container 3, e.g. for cleaning. With the object of simplifying their production, the bracket 37 and the plate 43 are therefore preferably made of plastic.

The tubular element 30 which constitutes the valve seat has in the preferred version two diametrically opposite radially protruding flanges 44, and the valve holder 36 has a plate 45, which flanges and plate serve as handgrips for extracting/inserting the valve body 10 from/into the tubular element constituting the valve seat. Similarly, the valve body 10 (see preferably FIGS. 4, 5, 9 and 10) has a radially protruding flange 46 which, after insertion into the tubular element 30 which constitutes the valve seat, protrudes from the tubular element via a slit 47 (see preferably FIGS. 7 and 8) in the latter. The slit 47 is provided in the tubular element 30 to likewise facilitate the extraction and insertion of the valve body 10, since the slit allows a certain dilation of the tubular element.

The hole 31 in the tubular element 30 which constitutes the valve seat largely corresponds in length to that of the tubular element and also increases in width in the outfeed direction, facilitating the feeding out of large amounts of the contents from the storage container 2.

The section 33 of the hose 32 constituting the valve body 10 which is of smaller wall thickness than other parts of the hose and which therefore abuts against the tubular element 30 round the hole 31 constitutes, in the version depicted, about half of the circumference of the hose. To simplify manufacture and at the same time achieve optimum fit between the hose 32 and the tubular element 30, in the version depicted the outside of the hose which abuts against the inside of the tubular element is unbroken and of the same diameter all round, whereas the inside of the hose has abrupt transitions 48 between the section 33 of smaller wall thickness and other parts 49 of the circumferential surface of the hose of relatively larger wall thickness.

One end 50 of the hose 32 constituting the valve body 10 is closed to prevent the contents of the storage container 3 from escaping at this end. This end 50 of the hose 32 is preferably also of greater wall thickness than the section 33 thereof which abuts against the tubular element 30 constituting the valve seat round the hole 31, with the object of stiffening the valve body 10. As preferably indicated by FIGS. 4 and 5, the end 50 of the hose 32 is directed upwards in its fitted position in the tubular element 30 which constitutes the valve seat.

As an alternative to the bracket 37 for the valve means 9, it is possible to provide in the bottom 4 of the outfeed container 3 a space 51 in which the inner connecting element 7 may be fitted (FIGS. 11 and 12). The outer connecting element 8 and, via it, a valve means (not depicted) are thereafter connected to the inner connecting element 7. As in the version with the bracket 37, this results in only small amounts of the contents of the storage container 2 remaining in the container, i.e. the storage container can be emptied completely or almost completely. According to FIG. 11, the space 51 for the inner connecting element 7 is situated entirely or largely below a hole 52 in the plate 43 which constitutes the bottom 4 of the outfeed container 3 or in the plate disposed on the bottom of the outfeed container. Thus the pressure plate 13 may be entirely or almost entirely planar. According to FIG. 12, the space 51 may be entirely or largely situated above a hole 53 for preferably the outer connecting element 8 in said bottom plate, in which case the pressure plate 13 has an elevation 54 to make it possible to accommodate therein said space for the inner connecting element 7. The inner connecting element 7 and the whole storage container 2 will thus be within the outfeed container 3.

It will be obvious to one skilled in the art that the present invention can be modified further within the scope of the claims set out below. For example, the cross-sectional shape of the hose constituting the valve body and of the tubular element constituting the valve seat may be different from the circular shape depicted, said tubular element may be of some other material than plastic, the ratio between the respective parts of said hose of smaller/larger wall thickness may be other than half each of the circumference of the hose, provided of course that the greatest width of the hole in the tubular element is smaller than that of the parts of the circumference of the hose of smaller wall thickness, and the shape of the valve holder may be different from the depicted circular cross-sectional shape, as also the bracket and said elements thereof. Similarly, the configuration and arrangement of the components of the discharge means may be other than as depicted and described above. For example, the configuration of the toothed track on the pressure application arm may be different, as also, for example, the outfeed container and the pressure plate which is insertable movably therein. The pressure means and the pressure application means are preferably made of metal but may also be made of, for example, plastic. As well as food items, the device according to the invention and the discharge means for the device may be used for outfeed of, for example, medicines, creams, soaps and other liquid or substantially liquid materials or substances. The volume of the storage container may be other than the 5 liters indicated above.

The invention claimed is:

1. A device for feeding out liquid or substantially liquid contents, preferably food items such as mayonnaise, mustard, tomato ketchup etc., from a flexible squeezable purpose-made storage container (2), the device comprising:

an outfeed container (3) in which said storage container (2) resting on the bottom (4) of the outfeed container (3) and being supported by sidewalls (5) of the outfeed container (3) is adapted to feeding out the contents therefrom; and a discharge means (6) at the top of the outfeed container (3) for pressure action from above upon the storage container (2) for feeding out at the bottom the contents from the storage container (2) by squeezing the discharge means;

in which said storage container (2) has a connecting element (7) disposed internally in the storage container by means of which the storage container for outfeed, is connectable to an outer connecting element (8) by penetration of the storage container wall at the inner connecting element (7); and in which said storage container (2) is connected via the outer connecting element (8) to a valve means (9) with a valve body (10) which in a resting position (V) abuts against a valve seat and which, for outfeed, is openable (Ö) by the contents of the storage container (2) being pressed against the valve body (10) so that the valve body is caused to leave the valve seat;

wherein:

the valve body (10) has elastic properties and a normal shape in which the valve body abuts against the valve seat so that the valve body closes the valve means (9);

the shape of the valve body (10) is variable so that when the valve body is subjected, for outfeed, to pressure from the contents of the storage container (2), the valve body is caused to change to a stretched shape and hence leave the valve seat; and the valve body (10) is adapted to reverting from stretched to normal shape when the pressure on the valve body from the contents of the storage container (2) ceases, in order to abut against the valve seat and rapidly close the valve means (9).

2. A device according to claim 1, wherein:

the valve seat has a tubular element (30) with at least one hole (31) in one side for the contents from the storage container (2), and the valve body (10) takes the form of a hose (32) made of or comprising flexible material, the valve body's outside abutting closely against the inside of the tubular element (30) round the hole (31) so that the hose (32) closes the hole.

3. A device according to claim 2, wherein the section (33) of the hose (32) which abuts against the tubular element (30) round the hole (31) is of smaller wall thickness than other parts (49, 50) of the hose (32).

4. A device according to claim 1, wherein when the valve body (10) assumes an open position (Ö), a substantially straight discharge channel (34) is formed in the valve body (10) and runs substantially coaxially with, and is of substantially the same diameter as, an outfeed channel (35) upstream of the discharge channel (34).

5. A device according to claim 2, wherein the valve body (10) in the form of a hose (32) is extractable from and reinsertable into the tubular element (30) which constitutes the valve seat.

6. A device according to claim 2, wherein the tubular element (30) which constitutes the valve seat is connected to the outer connecting element (8) via a substantially tubular valve holder (36) which delineates the outfeed channel (35) upstream of a discharge channel (34) and by means of which the valve body (10) is fixable in a substantially tubular bracket (37) at the bottom of the outfeed container (3).

7. A device according to claim 6, wherein the tubular element (30) which constitutes the valve seat, and said valve holder (36) and said outer connecting element (8) are mutually integral.

8. A device according to claim 6, wherein the bracket (37) for the valve body (10) comprises a substantially tubular slit element (39) of smaller diameter for firm snapping onto said valve holder (36) and, coaxially therewith, a substantially tubular slit element (41) of larger diameter for inserting therein said inner and outer connecting elements (7, 8) with associated parts of the storage container (2).

9. A device according to claim 8, wherein the smaller-diameter element (39) of the bracket (37) serves as a stop for a flange (42) on the valve holder (36) at the valve holder's transition or connection to the outer connecting element (8).

10. A device according to claim 6, wherein the bracket (37) for the valve body (10) on the outfeed container (3) is integral with a detachable plate (43) constituting the bottom (4) of the outfeed container (3) or a plate disposed on the bottom of the outfeed container.

11. A device according to claim 6, wherein the tubular element (30) which constitutes the valve seat has two diametrically opposite and radially protruding flanges (44), and the valve holder (36) has a plate (45), which flanges and plate serve as handgrips for extracting/inserting the valve body (10) from/into the tubular element (30) which constitutes the valve seat.

12. A device according to claim 2 wherein the length of the hole (31) in the tubular element (30) which constitutes the valve seat for the contents from the storage container (2) corresponds largely to that of the tubular element (30).

13. A device according to claim 2 wherein the hole (31) in the tubular element (30) which constitutes the valve seat increases in width in the outfeed direction.

14. A device according to claim 3 wherein the section (33) of the hose (32) constituting the valve body (10) which is of smaller wall thickness than other parts (49, 50) of the hose (32) constitutes about half of the circumference of the hose (32).

15. A device according to claim 3 wherein the hose (32) constituting the valve body (10) has an unbroken outside, but the inside has abrupt transitions (48) between the section (33) of smaller wall thickness and other parts (49) of the circumferential surface of the hose (32).

16. A device according to claim 3 wherein one end (50) of the hose (32) constituting the valve body (10) is closed and of larger wall thickness than the section (33) of the hose (32) which abuts against the tubular element (30) which constitutes the valve seat round the hole (31).

17. A device according to claim 5 wherein the valve body (10) has a radially protruding flange (46) which serves as a handgrip for extracting/inserting the valve body (10) from/into the tubular element (30) which constitutes the valve seat.

18. A device according to claim 17, wherein the flange (46) on the valve body (10), after insertion in the tubular element (30) which constitutes the valve seat, protrudes from the tubular element (30) via a slit (47) in the tubular element.

19. A device for feeding out liquid or substantially liquid contents, preferably food items such as mayonnaise, mustard, tomato ketchup etc., from a flexible squeezable purpose-made storage container (2), comprising:

an outfeed container (3) in which said storage container (2) resting on the bottom (4) of the outfeed container (3) and supported by sidewalls (5) of the outfeed container (3) is adapted to feeding out the contents therefrom, and a discharge means (6) at the top of the outfeed container (3) for pressure action from above upon the storage container (2) for feeding out at the bottom the contents from the storage container (2) by squeezing said storage container (2);

wherein the storage container has a connecting element (7) disposed internally in the storage container by means of which the storage container (2), for outfeed, is connectable to an outer connecting element (8) by the outer connecting element's penetration of the container wall at the inner connecting element (7); and wherein the storage container (2) is connected via the outer connecting element (8) to a valve means (9) with a valve body (10) which in a resting position (V) abuts against a valve seat and which, for outfeed, is openable (Ö) by the contents of the storage container (2) being pressed against the valve body (10) so that the valve body is caused to leave the valve seat; and wherein a space (51) in which the inner connecting element (7) is fittable is provided at the bottom (4) of the outfeed container (3).

20. A device according to claim 19, wherein the space (51) for the inner connecting element (7) is entirely or largely situated below a hole (52) in the plate (43) which constitutes the bottom (4) of the outfeed container (3) or in a plate disposed on the bottom of the outfeed container.

21. A device according to claim 19, wherein:

the space (51) for the inner connecting element (7) is entirely or largely situated above a hole (53) in the plate (43) which constitutes the bottom (4) of the outfeed container (3) or in a plate disposed on the bottom of the outfeed container, and a pressure means (11) forming part of the discharge means (6) and taking the form of a pressure plate (13) has an elevation (54) to make it possible to accommodate therein said space (51) for the inner connecting element (7).

22. A device for feeding out liquid or substantially liquid contents, preferably food items such as mayonnaise, mustard, tomato ketchup etc., from a flexible squeezable purpose-made storage container (2), comprising:

an outfeed container (3) in which said storage container (2) resting on the bottom (4) of the outfeed container (3) and supported by sidewalls (5) of the outfeed container (3) is adapted to feeding out the contents therefrom, and a discharge means (6) at the top of the outfeed container (3) for pressure action from above upon the storage container (2) for feeding out at the bottom the contents from the storage container (2) by squeezing said storage container (2);

wherein the storage container has a connecting element (7) disposed internally in the storage container by means of which the container (2), for outfeed, is connectable to an outer connecting element (8) by the outer connecting element's penetration of the container wall at the inner connecting element (7), and wherein the storage container (2) is connected via the outer connecting element (8) to a valve means (9) with a valve body (10) which in a resting position (V) abuts against a valve seat and which, for outfeed, is openable (Ö) by the contents of the storage container (2) being pressed against the valve body (10) so that the latter is caused to leave the valve seat;

wherein the storage container (2) with contents is to at least a substantial extent larger in circumference than the outfeed container (3) in which the storage container is disposed.

23. A discharge means for a device (1) for outfeed of liquid or substantially liquid contents, preferably food items such as mayonnaise, mustard, tomato ketchup etc., from a flexible squeezable purpose-made storage container (2), comprising:

an outfeed container (3) in which said storage container (2) resting on the bottom (4) of the outfeed container (3) and supported by sidewalls (5) of the outfeed container (3) is adapted to feeding out the contents therefrom; and said discharge means (6) at the top of the outfeed container (3) for pressure action from above upon the storage container (2) for feeding out at the bottom the contents from the storage container (2) by squeezing said storage container (2);

wherein the storage container has a connecting element (7) disposed internally in the storage container by means of which the storage container (2), for outfeed, is connectable to an outer connecting element (8) by the latter's penetration of the container wall at the inner connecting element (7); and wherein the storage container is connected via the outer connecting element (8) to a valve means (9) with a valve body (10) which in a resting position (V) abuts against a valve seat and which, for outfeed, is openable (Ö) by the contents of the storage container (2) being pressed against the valve body (10) so that the valve body is caused to leave the valve seat;

wherein the discharge means (6) comprises a pressure means (11), and a pressure application means (12) which, via the pressure means (11), exerts from above upon the storage container (2) in the outfeed container (3) a pressure for outfeed of the contents from the storage container (2) at the bottom of the latter.

24. A discharge means according to claim 23, wherein the pressure means (11) takes the form of a pressure plate (13) which is fittable movably in the outfeed container (3) and which, for outfeed of the contents from the storage container (2), is caused to abut and press against the storage container (2) and squeeze the latter against the bottom (4) of the outfeed container (3).

25. A discharge means according to claim 23, wherein the pressure application means (12) takes the form of a lever mechanism with a pressure application arm (16) which is connected articulatedly to the pressure means (11) and which, by means of an operating lever (17) to which said pressure application arm (16) is connected by a one-way connection, is movable for movement of the pressure means (11).

26. A discharge means according to claim 25, wherein the pressure application arm (16) is disconnectable by said one-way connection from the operating lever (17) so that the pressure means (11) can be moved back against the outfeed direction to an initial position for change of storage container (2).

27. A discharge means according to claim 23, wherein:

the pressure application means (12) comprises a pressure application arm (16) which is connected articulatedly to the pressure means (11) and which, by means of an operating lever (17) to which said pressure application arm (16) is connected, is movable for movement of the pressure means (11), for movement of said pressure application arm (16) the operating lever (17) is supported pivotably about a spindle (18) in a rail (20) which is connected to the outfeed container (3), and said pressure application arm (16) is placeable in a plurality of different functional positions in order, in particular as the storage container (2) is squeezed and emptied of its contents, to enable continued outfeed of the contents therefrom.

28. A discharge means according to 27, wherein each of said functional positions along the pressure application arm (16) is defined by a straight or a recessed tooth section (21) of a toothed track (22) running in the longitudinal direction of the pressure application arm, which tooth section (21) runs transversely or substantially transversely to the longitudinal direction of the toothed track (22).

29. A discharge means according to claim 28, wherein:

that the operating lever (17) has a recess (23) which runs through the arm in the arm's longitudinal direction and the operating lever has a spindle (24) running transversely through the operating lever; and the pressure application arm (16) extends through said recess (23) in such a way that the spindle in said recess is caused to cooperate with respective tooth sections (21) of the toothed track (22) of the pressure application arm for movement of the pressure application arm by means of the operating lever (17).

30. A discharge means according to claim 29, wherein:

the operating lever (17) is placeable by spring force in a first extreme position in which substantially no pressure action is exerted upon the storage container (2) via the pressure application arm (16);

for outfeed and pressure action upon the storage container (2) via the pressure application arm (16) the operating lever (17) is pivotable against the spring force towards a second extreme position; and in response to the outfeed ceasing, the operating lever is moved back by the spring force towards the first extreme position, with the result that the spindle in the recess in the operating lever is drawn along a tooth section of the toothed track on the pressure application arm which is positioned somewhat obliquely to the longitudinal direction of the toothed track.

31. A discharge means according to claim 30, wherein the pressure application means (12) is so configured that when the outfeed ceases, the operating lever (17) is moved back by the spring force towards the first extreme position, with the result that the spindle (24) is drawn along the toothed track (22) on the pressure application arm (16) for a distance which substantially corresponds to that by which the pressure application arm was moved during the outfeed.

32. A discharge means according to claim 30, wherein:

during outfeed the operating lever (17) is pivotable against the spring force to said second extreme position, and in response to the outfeed ceasing, the operating lever (17) is moved back by the spring force towards said first extreme position, with the result that the spindle (24) is drawn along the toothed track (22) on the pressure application arm (16) and is caused to assume the next functional position.

33. A discharge means for a device (1) for feeding out liquid or substantially liquid contents, preferably food items such as mayonnaise, mustard, tomato ketchup etc., from a flexible squeezable purpose-made storage container (2), comprising:

an outfeed container (3) in which said storage container (2) resting on the bottom (4) of the outfeed container (3) and supported by sidewalls (5) of the outfeed container (3) is adapted to feeding out the contents therefrom, and said discharge means (6) at the top of the outfeed container (3) for pressure action from above upon the storage container (2) for feeding out at the bottom the contents from the storage container (2) by squeezing said storage container (2);

wherein the storage container has a connecting element (7) disposed internally in the storage container by means of which the storage container (2), for outfeed, is connectable to an outer connecting element (8) by the connecting element's penetration of the container wall at the inner connecting element (7), and wherein the storage container (2) is connected via the outer connecting element (8) to a valve means (9) with a valve body (10) which in a resting position (V) abuts against a valve seat and which, for outfeed, is openable (Ö) by the contents of the storage container (2) being pressed against the valve body (10) so that the latter is caused to leave the valve seat, wherein the discharge means (6) comprises a pressure means (11), and a pressure application means (12) which, via the pressure means (11), exerts from above upon the storage container (2) in the outfeed container (3) a pressure for outfeed of the contents from the storage container (2) at the bottom of the storage container, and wherein the pressure means (11) takes the form of a pressure plate (13) which is fittable movably in the outfeed container (3) and which, for outfeed of the contents of the storage container (2), is caused to abut and press against the storage container (2) and squeeze the storage container towards the bottom (4) of the outfeed container (3), and which comprises means, preferably one or more lips (14) made of flexible material, which cooperate with the sidewalls (5) of the outfeed container (3) to prevent parts of the storage container (2) from becoming jammed between the pressure plate and the outfeed container (3) when the pressure plate (13) is pressed downwards.

34. A discharge means according to claim 33, wherein one or more depressions (15) for said means, preferably one or more lips (14) made of flexible material, and for wall sections of the storage container (2), is/are provided in the bottom (4) of the outfeed container (3).

* * * * *